US009776690B1

(12) United States Patent
Sledzinski et al.

(10) Patent No.: US 9,776,690 B1
(45) Date of Patent: Oct. 3, 2017

(54) VERTICAL MARKER BUOY

(71) Applicant: SPAWAR Systems Center Pacific, San Diego, CA (US)

(72) Inventors: Theodore Albert Sledzinski, San Diego, CA (US); Mark Gillcrist, San Diego, CA (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 0 days.

(21) Appl. No.: 15/240,762

(22) Filed: Aug. 18, 2016

(51) Int. Cl.
*B63B 22/08* (2006.01)

(52) U.S. Cl.
CPC ..... *B63B 22/08* (2013.01); *B63B 2201/08* (2013.01); *B63B 2201/16* (2013.01); *B63B 2207/00* (2013.01)

(58) Field of Classification Search
CPC ..... B63B 22/00; B63B 22/04; B63B 22/08; B63B 22/16; B63B 22/166; B63B 22/18; B63B 22/20; B63B 2201/00; B63B 2201/08; B63B 2201/16; B63B 2207/00; B63B 2207/02; B63B 2022/00; B63B 22/02
USPC ..... 441/1, 3, 6, 11, 13, 16, 21, 23, 28, 7
See application file for complete search history.

(56) References Cited

U.S. PATENT DOCUMENTS 747,114 A 12/1903 Allison
2,099,506 A 11/1937 Winckler
2,110,596 A * 3/1938 Gaede ..... A01K 93/02 362/157
2,119,854 A * 6/1938 Day ..... B63B 22/166 441/17
2,903,716 A * 9/1959 Zasada ..... B63B 22/02 441/21
3,037,217 A * 6/1962 Mandra ..... B63B 22/00 441/20
3,397,413 A * 8/1968 Houtsma ..... B63B 22/16 441/20
3,423,777 A 1/1969 Feyling
3,550,549 A 12/1970 Horton
3,818,428 A * 6/1974 Phipps ..... B63B 22/003 340/321

(Continued)

OTHER PUBLICATIONS

"Sur-Mark™ Marker Buoys," Taylor Made, Online Catalogue, http://www.taylormadeproducts.com/cgi-bin/catalog.pl?item_id=71, 2016, pp. 1-3.
"Regulatory Buoys," Taylor Made, Online Catalogue, http://www.taylormadeproducts.com/cgi-bin/catalog.pl?item_id=73, 2016, pp. 1-3.

(Continued)

*Primary Examiner* — Daniel V Venne
(74) *Attorney, Agent, or Firm* — SPAWAR Systems Center Pacific; Kyle Eppele

(57) ABSTRACT

A vertical marker buoy and method for deployment are disclosed herein for enhanced detection of equipment on the water's surface. The equipment may have been previously submerged at a significant depth. The buoy and method provide a faster and more reliable means to locate equipment, e. g., at the sea surface or suspended by a float. The marker buoy has flotation device, a detection indicator and a bail mounted to a tube. The marker buoy is configured to be positioned in a substantially vertical position when the vertical marker buoy is in use on the surface of a body of water. The vertical marker buoy is capable of being deployed at an underwater depth.

20 Claims, 5 Drawing Sheets

(56) References Cited

U.S. PATENT DOCUMENTS

| | | | | | |
|---|---|---|---|---|---|
| 3,858,166 | A | * | 12/1974 | Hammond | B63B 21/02 294/66.1 |
| 3,893,201 | A | | 7/1975 | Mallory | |
| 4,042,990 | A | | 8/1977 | Donaldson, Jr. | |
| 4,067,202 | A | | 1/1978 | Reed | |
| 4,136,415 | A | * | 1/1979 | Blockburger | B63B 21/60 24/599.1 |
| 4,949,643 | A | | 8/1990 | Bowersett et al. | |
| 5,095,841 | A | | 3/1992 | Santos et al. | |
| 6,062,158 | A | | 5/2000 | Blanchard | |
| 6,102,758 | A | * | 8/2000 | Smith | B63B 22/00 441/1 |
| 6,261,142 | B1 | | 7/2001 | Fiotakis | |
| 7,819,712 | B1 | | 10/2010 | Winter | |
| 8,047,590 | B1 | | 11/2011 | Hamme | |

OTHER PUBLICATIONS

"Mast Buoys," Taylor Made, Online Catalogue, http://www.taylormadeproducts.com/cgi-bin/catalog.pl?item_id=74, 2016, pp. 1-3.

"Multi-Purpose and Channel Marker Buoys:Sentinel® Buoy," Tideland, Online Brochure, http://www.tidelandsignal.com/2014/data/Buoys-small-1400/MULTIPURPOSE-BUOYS-REV09.pdf, 2016.

"Mooring Recovery Float," McClane Labs, Online Brochure, http://www.mclanelabs.com/sites/default/files/sub_page_files/McLane-Mooring-Recovery-Datasheet_0.pdf, 2016, 1p.

"VHF Radio Locating System," MetOcean, Online Brochure, http://www.metocean.com/sites/default/files/files/products/pdfs/rf-700a1.pdf, 2016, pp. 1-2.

"Visual locating system," MetOcean, Online Brochure, http://www.metocean.com/sites/default/files/files/products/pdfs/st-400a_0.pdf, 2016, pp. 1-2.

* cited by examiner

VERTICAL MARKER BUOY

FEDERALLY-SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif., 92152; telephone (619)553-5118; email: ssc_pac_t2@navy.mil. Reference Navy Case No. 102,684.

BACKGROUND OF THE INVENTION

Field of Invention

The present disclosure pertains generally to buoys and, more particularly, to vertical marker buoys.

Description of Related Art

Challenges may be presented in finding equipment at the surface of a large body of water, particularly where the equipment has been released after being held underwater in a deep sea or ocean. Finding the equipment may be especially difficult when it is impractical or undesirable to use a permanent line from the equipment to a surface float. In a prior art solution, a mechanism may be attached to the equipment to do one of two things. The mechanism may release a float on a line to the surface. Alternatively, the mechanism may drop ballast and allow the equipment with attached floats to ascend to the water's surface.

Equipment released from a deep mooring takes a considerable amount of time to reach the surface. For example, the deeply moored equipment may take a few minutes to an hour to reach the surface, depending on the depth, drag and buoyancy of the equipment. Over the course of the time it takes for this equipment to reach the surface, both the equipment and the float that is carrying it to the surface, may be acted on by currents. Depending on the speed of the current, the equipment can be carried far out of sight of a recovery vessel. Even without currents, objects passing through the water column may have some horizontal movement or glide. This movement or glide can cause the equipment to be carried out of sight.

Not only are challenges encountered in finding equipment at the water's surface, but additional challenges are encountered in finding equipment on the water's surface after the equipment's release from an undersea mooring. Not only might the equipment disappear due to the distance it travels, but the equipment can also be hidden by waves. When the equipment is in the trough of a wave, objects with minimal vertical height above the water surface may be very difficult to detect. This difficulty may increase with distance between the floating equipment and recovery vessel.

When operating in fairly shallow depths, in order to mark equipment, it may be adequate to have a float double as both a source of buoyancy and a marker of the location of the equipment. This solution may work reasonably well so long as it takes only a short while for the float to reach the surface and provided that the bottom location of the float is precisely known. However, in progressively deeper water, the uncertainty in the location of the equipment on the bottom becomes much greater. Objects descending through the water column tend to glide in one direction or another, and they are also pushed by currents, sometimes in different directions and at different depths.

Even if means are available to determine the location of the float (or equipment) on the bottom, the same forces of glide and current will again act when the float is released and ascends to the surface. There is a need for a solution to more reliably determine the location of equipment released from significant subsea depths.

One way of increasing the detectability of equipment on the surface is to use a very large float, which primarily provides flotation, but also performs double duty as a marker. However, using a single device for purposes of both flotation and detection involves design compromises. The typical float is a sphere. Spheres may make poor radar targets even if the spheres have metal surfaces. Also, the weight of the equipment keeps much of the float submerged, reducing its detectability. Large floats, moreover, are difficult to safely deploy and recover. They may not fit through a typical chute used for such purposes, and they can be too heavy to move without a crane.

There is a need for a lightweight solution; one sufficiently slender to fit through a chute and to project high enough above the surface of the water to be easily detected.

There is further a need for a solution for determining the location of equipment that is easier to deploy and recover than existing solutions.

BRIEF SUMMARY OF INVENTION

The present disclosure addresses the needs noted above by providing a vertical marker buoy and a method of deploying the buoy for detection of surface equipment.

In accordance with one embodiment of the present disclosure, a vertical marker buoy is provided for detecting the location of surface equipment. The buoy comprises a first tubular member having an inner cylindrical wall, an outer cylindrical wall, a proximal end, a distal end and a length. The buoy further comprises at least one flotation device having an inner cylindrical wall that is fixedly attached to the proximal end of the outer cylindrical wall of the first tubular member, wherein the width of the at least one flotation device is less than the length of the at least one flotation device. The buoy also comprises at least one detection indicator configured to indicate a location for the buoy. The detection indicator is mounted at the proximal end of the marker buoy.

The buoy also includes a bail that is rotatably attached to the first tubular member. The bail is sufficiently long and wide to rotate around the length of the first tubular member. The vertical marker buoy is configured to maintain positive buoyancy when the surface equipment is attached to the vertical marker buoy. The vertical marker buoy is configured to be positioned in a substantially vertical position on the surface of a body of water when the vertical marker buoy is in use. The vertical marker buoy is capable of being deployed from an underwater depth.

These, as well as other objects, features and benefits will now become clear from a review of the following detailed description, the illustrative embodiments, and the accompanying drawings.

BRIEF DESCRIPTION OF DRAWINGS

The accompanying drawings, which are incorporated in and form a part of the specification, illustrate example embodiments and, together with the description, serve to explain the principles of the invention. In the drawings.

DETAILED DESCRIPTION OF THE INVENTION

A vertical marker buoy and associated deployment method are described herein for detection of surface equipment. The buoy and method provide a faster and more reliable means to locate equipment, e. g., at the sea surface or suspended by a float. The subject equipment may have been released from an underwater mooring, or it may have otherwise been held underwater. The present buoy and method may be used in situations where a line from the moored equipment to a surface float is impractical or undesirable.

The marker buoy may have a proximal end that projects above the waterline which increases both the likelihood and the speed of detection. The marker buoy characteristics may be designed to significantly increase its detectability at the surface, and to ensure that it can withstand the significant subsea depths to which it may be taken. The vertical marker buoy of the present disclosure can be taken down several thousand meters below sea level. It does so with a minimum of mass and bulk, facilitating deployment and recovery, and also increasing the ease and safety of handling on deck.

When the vertical marker buoy appears at the surface of a body of water, the marker buoy floats vertically at the water's surface. When the buoy is on the surface of a body of water, the buoy's proximal end may appear above the waterline. The proximal end may include a detection indicator that indicates the location of the buoy and the attached equipment. The distal end of the marker buoy may have a bail and mooring line that permit the attachment of surface equipment to other floats. These additional floats may provide the flotation needed to support the equipment until the equipment is recovered. The vertical marker buoy may appear at the surface of a body of water after it has been deployed to and/or from a subsea depth or mooring. The buoy described in the present disclosure can be deployed from underwater/subsea depths or moorings that are thousands of meters below the surface of a body of water.

Figure 1:
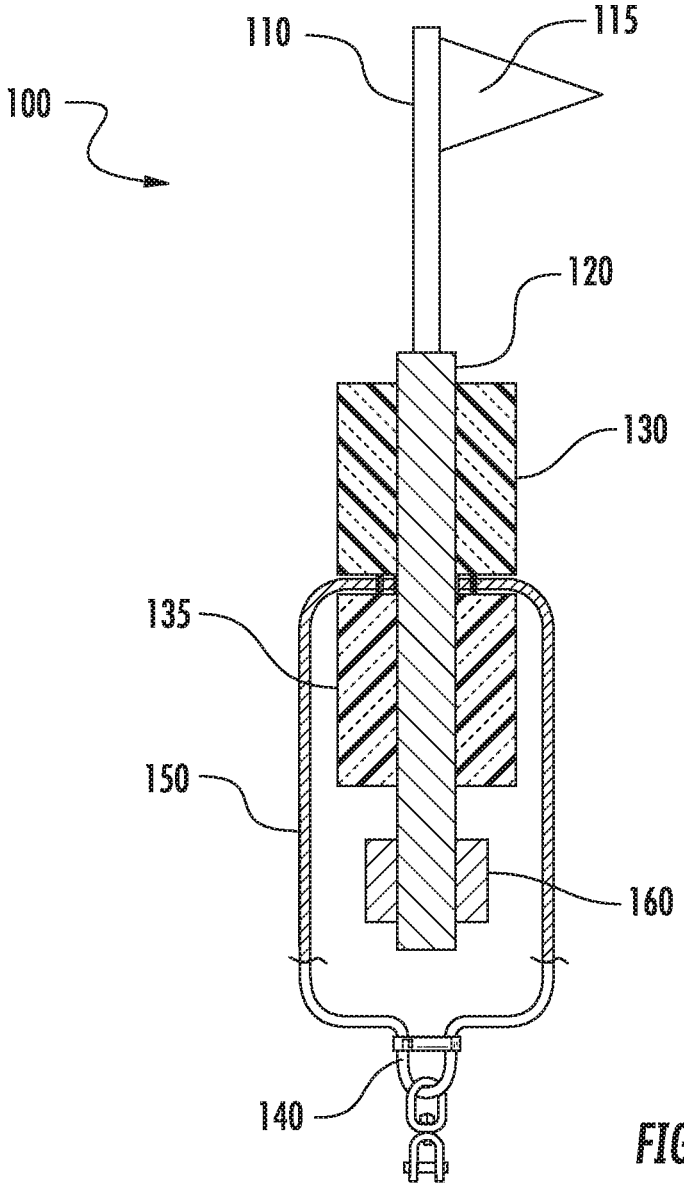
FIG. 1 is a side elevation cutaway view of a vertical marker buoy in accordance with one embodiment of the present disclosure.

Referring now to FIG. 1, illustrated is a side elevation cutaway view of a vertical marker buoy 100 in accordance with one embodiment of the present disclosure. As shown in FIG. 1, buoy 100 includes a small tube 110 or pipe at the proximal end, which is the top end when buoy 100 is substantially vertically positioned at the surface of a body of water. A flag 115 may be attached to the tube 110. Tube 110 is sometimes described herein as second tubular member. Flag 115 may act as a visual indicator of the location of buoy 100 and associated equipment 117, which may be surface equipment that is at the surface of a body of water, or attached to an object (including a float or buoy, not shown) that is at the surface of the body of water, so that buoy 100 and associated equipment 117 may be detected on the surface of a body of water. Tube 110 may also be rigid in order to hold flag 115 above water when the buoy 100 is in use. In lieu of flag 115, other detection indicators may be used, e.g., a radio beacon, a radar reflector or a flashing light.

Tube 110 is lightweight, particularly since the weight at the proximal end of tube 110 and/or buoy 100 must be counterbalanced by weight at the distal end. Tube 110 may be composed of PVC material or other lightweight material that can be buoyant. If buoy 100 is too heavy, it may be difficult for buoy and associated equipment to float to the surface so that the equipment may be detected or located.

Another tube 120 or pipe having a greater diameter than tube 110 is disposed around the first tube 110 or pipe. Tube 120 is sometimes described herein as first tubular member. The outer wall of tube 110 may be sized so that it is sufficiently small to fit within the inner cylindrical wall of tube 120. Tube 110 may be connected to tube 120 via attachment means such as screws, nuts and bolts. Alternatively, a reducing fitting may also be used to attach tubes 110, 120 to each other. For example, if the inner cylindrical wall of tube 120 is four (4) inches and the outer cylindrical wall of tube 110 is one and one half (1½) inches, the reducing fitting could be substantially four (4) inches at one end and one and one half (1½) inches at the other end. Tubes 110, 120 may be plastic pipes, composed of e.g., polyvinyl chloride (PVC).

Flotation devices 130, 135 have inner cylindrical walls that may be fixedly attached to the outer cylindrical wall of tube 120 via attachment means such as screws, nuts and bolts. Flotation devices 130, 135 may be disposed around the outer circumference of tube 120. The flotation devices 130, 135 are comprised of a material that is sufficiently light to provide positive buoyancy to other parts of the buoy 100. The material is lighter than water. The material may also be selected for flotation devices 130, 135 based on how long the surface equipment to be attached is desired to be kept underwater and the depth to which the equipment will travel. The material should also be resistant to deformation at such depths. If the surface equipment is going to be underwater for a short period, e.g. a few minutes, and in relatively shallow water, then the selection is easier than if the surface equipment will be submerged for a lengthy period of time in deep water. The volume of the material used for flotation devices 130, 135 may also be a factor. Syntactic foam is an example of a material that may be used for flotation devices 130, 135. Syntactic foam is a composite material that incorporates hollow particles in a matrix. The material may be chosen according to calculations known in the art. Syntactic foam maintains buoyancy over time. Syntactic foam is heavy relative to its buoyancy, but it can be cast into virtually any shape, and it can be machined without fear of damaging its structural integrity or its water-tightness. These qualities may allow for selection of precisely the desired amount of flotation. Syntactic foam may also withstand severe impact without damage.

Another material that may be used to construct flotation devices 130, 135 is glass. Hollow glass hemispheres may be used as flotation devices 130, 135 and may be held together by a vacuum. These hollow glass hemispheres may have more buoyancy for their volume and weight than syntactic foam. Such glass spheres are commercially available, e. g., TELEDYNE BENTHOS® glass spheres. However, because the glass hemispheres do not typically have a center hole, it may not be possible to simply slide a tube 120 through them. It may be desirable to hold these glass hemispheres together into a vertical column by some configuration or connection device (such as placement inside a tube or surrounding with a cage or bolting together plastic "hard hats" designed to fit the floats). Then a pole, or possibly two lengths of pole, one on the top and one on the bottom, may be attached to whatever is holding them together. Another material, hollow plastic floats, may be unreliable because at depth they may deform and lose buoyancy. Flotation devices 130, 135 may be fixedly attached to tube 120 via stainless steel bands. In the buoy 100 of the present illustration, flotation devices 130, 135 may be about three times as high as they are wide. For example, the height of flotation devices may be thirty-three inches (33"), while the width may be about eleven inches (11") to thirteen inches (13").

Mooring line attachment 140 and bail 150 are also illustrated. Bail 150 is composed of material shaped into a tube or rod. Bail may be composed of a lightweight, rigid material, e.g., thin wall type 316 stainless steel tubing, that is sufficiently strong that it can withstand the stresses of deployment and recovery without significant deformation. In the present illustration, bail 150 connects to tube 120 at a place between flotation device 130 and flotation device 135. The bail 150 is attached to the buoy 100 at or slightly below the water line (the level to which the buoy 100 naturally sinks when fully equipped). This is done so that as the buoy 100 is always able to maintain a vertical position.

Bail 150 is sufficiently long to swivel around the length of buoy 100 so that it clears all the buoy components. Bail 150 is able to rotate in order to compensate for varying directions in which attached surface equipment may be pulled. Bail 150 is wider than the flotation devices 130, 135 so that it does not interfere with the operation of other portions of buoy 100.

A mooring line (not shown in FIG. 1) may be used to connect the buoy 100 to a water vessel, and the mooring line may attach to the bail 150 via mooring line attachment 140. Bail 150 may be used to help keep the mooring line from tangling around the buoy 100. Bail 150 may also be used to keep the mooring line from being attached to flotation devices 130, 135.

Bail 150 may be accompanied by an auxiliary float (not shown), e.g., a seventeen inch (17") glass sphere. The float may be attached via a short line (e.g., one to two feet long) to the swivel at the end of the bail 150. The float may help to support the weight of the bail 150 on the surface, to aid the ascent of the marker buoy 100. The float may also be used to help keep the mooring line (which is attached to other floats and the equipment that is being recovered) from getting tangled around the marker buoy 100. If the mooring line becomes tangled around marker buoy 100, the buoy 100 may be incapable of floating vertically and the recovery aids may not be useful. In lieu of being attached to bail 150, mooring line may be attached directly to the tube 120 and its inner cylindrical wall at the distal end of tube 120. After deployment, the buoy 100 may be pulled in by a water vessel or other suitable vehicle or vessel to which the buoy 100 may be attached.

The present buoy 100 differs from the prior art in that some prior art buoys include a mount on the bottom in lieu of bail 150. This bottom mount may work fine on deployment, when a buoy is descending towards the bottom, and may work reasonably well when a buoy is initially released and heads back up to the surface. It does not work well on the surface, where due to winds, waves or currents the buoy will be pushed or pulled towards a horizontal position, minimizing visibility and likely making whatever aids to detection with which it might be equipped only marginally functional.

One possible alternative to a bottom mount is to attach the mooring line about where the bail 150 attaches. This would solve the problem on the surface, but then there would be a potential problem when the buoy 100 descends towards the bottom and again when it ascends to the surface. In both instances, it would likely be traveling through the water at about a right angle to the direction of travel. This would cause more drag, increasing the time it takes to get to the surface and probably also causing more horizontal travel, both of which would likely take the buoy farther from the vessel. More importantly, the increased drag could potentially damage the structure or any attached instruments.

The ballast 160 is comprised of external weights. The ballast 160 is attached to the bottom of the pipe and to a smaller section of pipe, which is designed to serve as a mast and hold an aid to recovery. Ballast 160 may be comprised of materials e.g., those used for scuba diving equipment. Ballast 160 may be held in place onto tube 120 with stainless steel bands. The weight of ballast 160 should be sufficient to counterbalance the weight of the remaining elements of buoy 100 so that buoy 100 remains vertical when the attached equipment reaches the surface of a body of water.

When the buoy 100 is fully equipped, the vertical marker buoy 100 maintains positive buoyancy and is less dense that the water around it so that it can remain in a substantially vertical position when at the surface of a body of water. The weights that are included in ballast 160, as well as the weights in the equipment to be attached, should be taken into account when making such a buoy 100 to maintain positive buoy. The heavier the buoy structure and attached equipment, the more difficult it may become to maintain positive buoyancy. Therefore, it may be desirable to use lightweight materials when making buoy 100. The positive buoyancy also enables any detection indicators or recovery aids such as flag 115, radio beacon (not shown), flasher (not shown) or radar reflector (not shown), to be seen at or near the surface of the water.

With the present buoy 100, the functions of flotation and detection are separated into different structures, allowing each to be individually optimized. The standard approach of having a buoy or set of buoys that do both is invariably a compromise. The compromise solution reduces how much of the buoy is above the surface of the water and, hence, how likely or easy it is for a vessel to spot the buoy on the surface. Separation of function also allows the portion of the buoy providing each function to be smaller and lighter. This allows for much easier handling both on the deck of a ship and in deployment and retrieval.

The present buoy's vertical design increases the detectability of equipment once it is on the surface by increasing the distance above the water level that the buoy is visible and, hence, increasing the distance at which a vessel can spot the buoy. The standard solution of mounting on a sphere or horizontal float provides a much shorter range of detection or a much smaller probability of detection. Use of the vertical buoy shape also provides an advantage for deployment and recovery, as the slim profile allows it to be deployed and recovered through a chute. In accordance with the present disclosure and as shown in the drawings, the height of the buoy is significantly greater than its width. The flotation devices 130, 135 are generally much shorter in length than the combined length of tubes 110 and 120. This is not possible with a large diameter float. Moreover, this design is lightweight, whereas existing solutions tend to be much heavier. Additionally, this design stays more stationary in the water. Horizontal buoys roll considerably more with the waves, and other buoys may suffer from this shortcoming. For example, buoys may roll more with the waves when they have flotation devices that are wider in relation to the water's surface than they are high so that they can project above the water's surface.

The shape of flotation devices 130, 135 will cause the present buoy 100 to behave much more like a true spar buoy. An object that is floating vertically, like a spar buoy, may be much less affected by passing waves. It may remain nearly perfectly vertical in most conditions.

The vertical marker buoy may be easily seen by someone in a boat. The greater the distance from which it can be seen, the better. The higher the buoy 100 stays above the surface, the farther away it can be seen due to waves and, at longer distance, the curvature of the earth. The height of vertical marker buoy 100 may be further increased by lights (not shown in FIG. 1) or a radar reflector (not shown in FIG. 1) or another object mounted at its top.

The present vertical marker buoy 100 is long and thin. As such, it can be easily slid over the railing of a ship, regardless of whether it is going into the water or being pulled out. The buoy 100 is also sufficiently narrow to fit comfortably into many chutes that are designed for ropes or other types of lines or equipment.

Buoys in general may be towed behind a ship just prior to deployment in order to reduce chances of the mooring line (not shown) getting wrapped around some part of the entire mooring system. During this time, and also during the time the typical buoy is descending into water and again when the buoy is rising to the surface, there is a chance that part of the mooring line will wrap or twist around some part of the one or another of the object being deployed. This chance is minimized with a streamlined shape such as the vertical marker buoy 100, A number of design considerations come into play in designing the vertical marker buoy 100. Considerations include: how high above the water the recovery aids (e.g., flashers, radio direction finders, radar reflectors, flags or other daytime visual markers, etc., not shown in FIG. 1) need to be located; which recovery aids will be used and their weight in air; overall dimensional constraints (due to handling safety and ease, transportation restrictions, cost, and structural integrity); overall weight constraints (due to handling safety and ease, transportation restrictions, etc.); ease of assembly in the field or at sea if it is shipped in a disassembled configuration; cost constraints; ocean depths the buoy needs to be able to withstand; and whether a bail will be utilized to reduce the likelihood of line tangling or to provide an ideal line attachment point.

Once initial specifications are provisionally decided, then material selection can begin, perhaps starting with the tube 120.

Tubes 110, 120 form the backbone to which the flotation devices 130, 135, ballast 160 and instruments, such as radar reflectors (not shown in FIG. 1) and beacons (not shown in FIG. 1), are attached. Ideally, the tubes 110, 120 should be fairly stiff, able to withstand rough handling, and be as light as possible. Different materials and different dimensions could be used for different sections of the pole, say the above water section versus the below water section, but a simple one-piece tube (not shown) may avoid the complexity and possible structural weakness of having to join sections together. However, if a stack of glass spheres was used for flotation devices instead of the syntactic foam flotation devices 130, 135, then it would be necessary to have one section of tube at the top of the stack and a second section of tube at the bottom such as shown in FIG. 1 as tubes 110, 120, respectively. In this case, using tubes of different dimensions or made of different materials could be preferable.

Fiberglass tubes are a widely available and relatively inexpensive option for tubes 110, 120, as are certain other types of plastic tubes such as polycarbonate or Lexan. Thin-walled tubing of a metal such as an appropriate marine grade of aluminum alloy could also be used. It may be desirable that the chosen material not become brittle at the near-freezing water temperatures encountered at deep depths. It may also be desirable that the chosen material not soften and distort when stored on the hot deck of a vessel.

The underwater section of tube 110 and/or tube 120 could be made of a heavier (per unit length) material than that which is above water, with the weight of the tube 110 and/or 120 forming part of the needed counterweight (such as ballast 160).

Another option for the underwater section of the tube 120 is to use a material that is neutrally or positively buoyant, such as Ultra High Molecular Weight Polyethylene. This would potentially allow a larger counterweight to be used and it could be used to maximal effect by placing all the weight at the far end of the tube 120. Overall weight calculations may be used to maintain an upright position for the vertical marker buoy 100 when the buoy is in operation. The vertical marker buoy 100 with its payload of instruments (not shown in FIG. 1) and ballast 160 may float so that the waterline is within a few inches of the top of the flotation device 130. The few inches floatation above waterline provides an ample amount of reserve flotation without substantially impacting the verticality of the vertical marker buoy 100.

Flotation device 135, the lower and mostly underwater portion of the flotation, must be sufficient to support the weight of any attached recovery aids, including the weight of mounting brackets, etc., for the recovery aids. Flotation device 135 must also be sufficient to support the weight of the in-air portion of tube 110 and/or tube 120, weight of the in-air portion of the flotation device 130, the in-water weight of the in-water portion of the tube, and the in-water weight of the counterweight (such as ballast 160).

The ballast 160 may be slightly heavier than the combined weight of any attached recovery aids, including the weight of mounting brackets, etc. for the recovery aids, the weight of the in-air portion of tube 110 and/or tube 120, and the weight of the in-air portion of the flotation device 130. This slight excess of weight of the ballast 160 when combined with the weight of the in-air portion of the flotation 130, will be approximately adequate to hold the buoy 100 vertical if the height of the tube 110 above the waterline is about equal to the depth of the tube 110 and/or 120 below the waterline.

The weights of some components of the buoy 100 can be taken as something that is fixed. Those of the others can be varied somewhat. The tube 110 and/or 120 can be lowered to reduce the net weight of buoy 100 and also to increase the ability of the buoy 100 to float vertically (by locating the ballast 160 farther below the waterline). The ballast 160 can be made slightly heavier or lighter, affecting both the stability of the buoy 100 and the height of the recovery aids above the waterline.

If weights have been accurately calculated, only a few small iterations of the height of tube 110 and/or 120 or amount of ballast 160 should be sufficient to result in buoy 100 staying vertical and quickly returning to vertical if it is pushed over to one side.

Generally, the higher the recovery aids are held above the waterline, the better, limited by the ability of the buoy 100 to strongly maintain its upright posture.

Figure 2:
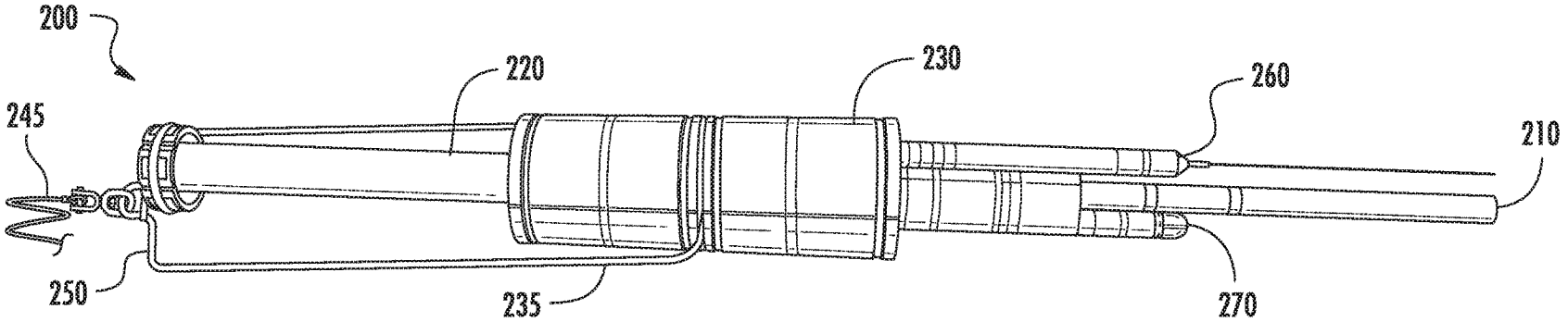
FIG. 2 is an illustration of a vertical marker buoy with a radio beacon and a flasher in accordance with one embodiment of the present disclosure.

The marker buoy of the present disclosure optionally provides a mounting surface for aids to detection and recovery such as a radio beacon, flashing light, or radar reflector. Referring now to FIG. 2, illustrated is another version of the buoy 200 in accordance with one embodiment of the present disclosure. FIG. 2 is a side view of the buoy 200 with the proximal end of buoy 200 shown to the right and the distal end of buoy 200 shown to the left. The illustrated buoy 200 is similar to the buoy 100 in FIG. 1 in that buoy 200 includes a small tube 210 which extends through the entire length of tube 220. Tube 220 is sometimes referred to herein as first tubular member, while tube 210 is sometimes referred to herein as second tubular member. Flotation devices 230, 235 are adjacent to each other. Each of flotation devices 230, 235 is connected to the outer cylindrical wall of tube 220. As shown in FIG. 2, mooring line attachment 245 may include a swivel connector that attaches it to bail 250.

In addition, this buoy 200 also includes a radio beacon 260 and a flasher 270, which are attached to the mast. The radio beacon 260 may be used to transmit at a specified radio frequency in order to permit the buoy 200 and attached surface equipment to be found. The specified frequency may be designated in order to reduce the possibility that another entity is transmitting at the specified frequency. Radio beacon 260 may transmit a continuous or alternatively, periodic, radio signal with information that may include its location. The radio beacon 260 may transmit on a specified radio frequency. Beacon 260 may be purchased along with a compatible receiver (not shown). The radio beacon 260 may be chosen based on the distance it needs to transmit as well as its ability to withstand the desired subsea depth. Tube 220 protects the radio antenna (not shown in FIG. 2) for radio beacon 260, as the beacon is enclosed within tube 220.

Flasher 270 may simply be a flashing light that illuminates to show the physical location of the surface equipment. It may be particularly useful in the dark. The radio beacon 260 and flasher 270 may aid recovery of the buoy 200. It may be desirable to mount these instruments a distance above the surface of the water to increase the likelihood that they will be detected by a searching vessel. Mounting these instruments on a spherical or horizontal float, which is more traditional, provides only a very limited range of detection.

Figure 3:
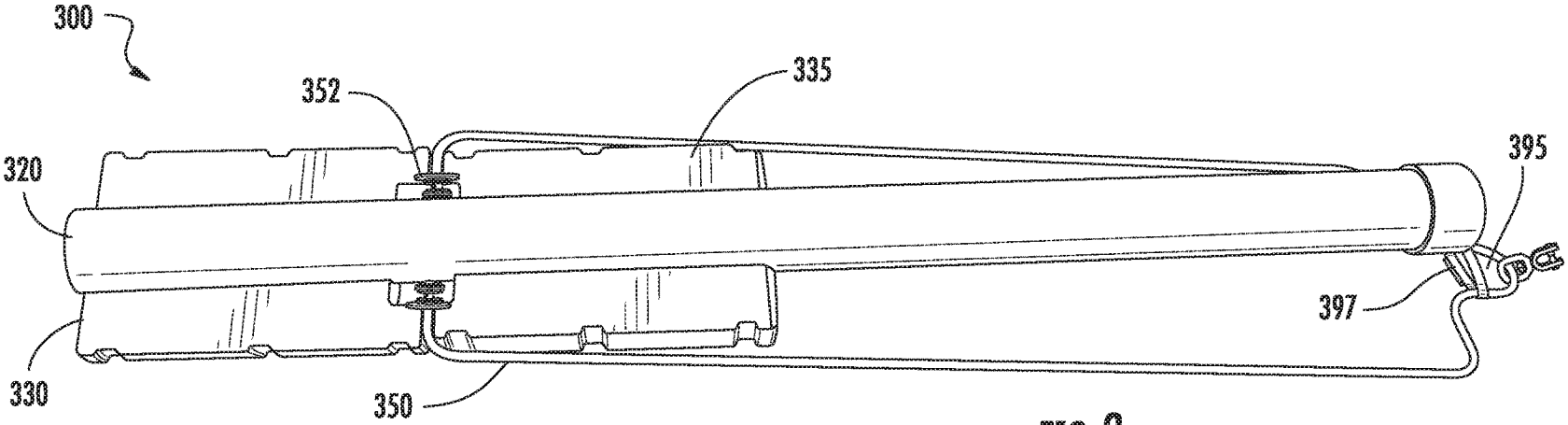
FIG. 3 is an illustration of a bail attachment and bail in accordance with one embodiment of the present disclosure.

Referring now to FIG. 3, illustrated is a buoy 300 with a tube 320. Flotation portion 330 is disposed around tube 320. Flotation devices 330, 335 are also disposed around the circumference of tube 320. Bail 350 is attached to the tube 320. Bail 350 may also be bolted onto a smaller diameter tube (not shown) disposed within tube 320 to keep bail 350 secure. This embodiment of buoy 300 shows the length of bail 350 relative to the buoy. The bail 350 is sufficiently long and wide that it may freely rotate around each end of buoy 300. In this view, bail 350 has been swiveled from the distal end of the buoy 300 at the left to the proximal end of the buoy 300, shown to the right of the illustration. In one embodiment, the buoy 300 may be about ten (10) feet long and the flotation is only 16" wide. The bail 350 may rotate in a full circle, i.e., 360 degrees around buoy 300. Bail 350 is also sufficiently wide that it does not hit other components of buoy 300 during rotation. Bail 350 clears other parts of the buoy 300 in order to freely rotate around the buoy 300. Bail 350 is attached to the tube 320 via a swivel connector 352 or other connection means. Swivel connector 352 facilitates the rotation of bail 350 around each end of buoy 300 so that bail 350 may traverse the full length of buoy 300. Bail 350 has a loop 395 at the end. A stainless steel band 397 is disposed across the width of loop 395.

Figure 4:
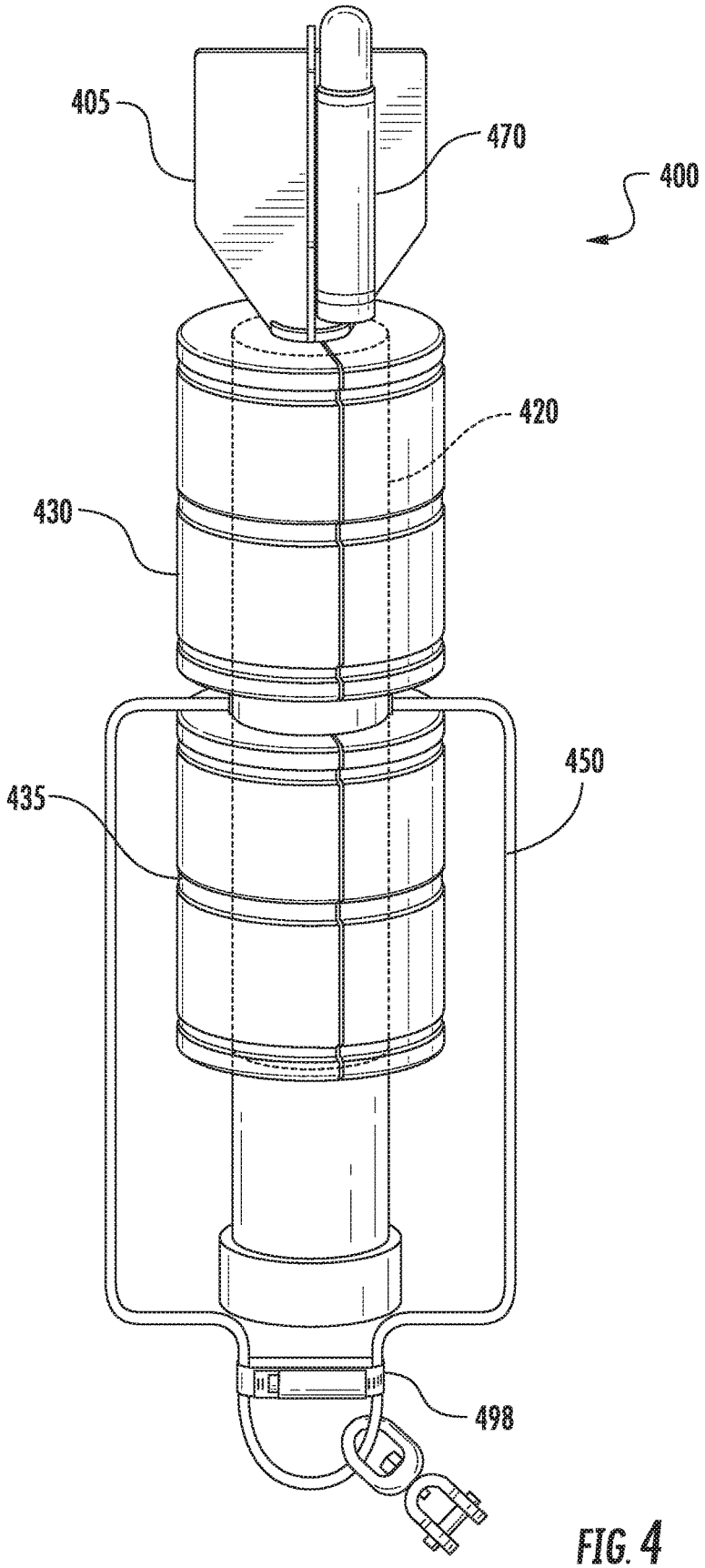
FIG. 4 illustrates the marker buoy with a radar reflector and flasher, in accordance with one embodiment of the present disclosure.

Referring now to FIG. 4, illustrated is a version of the buoy 400 with a large radar reflector 405. This optional radar reflector 405 forms a structural component of the buoy 400, providing a mount for signaling devices. The radar reflector 405 is mounted directly onto tubular member 420. The bottom of radar reflector 405 slides into the open top end of the tubular member 420 and is attached with a bolt (not shown in FIG. 4).

A tubular member 420 has an inner cylindrical wall through which radar reflector 405 may be mounted using attachment means such as screws, nuts or bolts.

Flotation devices 430, 435 have inner cylindrical walls that attach to the outer cylindrical wall of tube 420. Flotation devices 430, 435 may be disposed around the outer circumference of tube 420. The flotation devices 430, 435 are comprised of a material that is sufficiently light to provide positive buoyancy to other parts of the buoy 400. Bail 450 is rotatably mounted to tube 420 using a swivel connector or other suitable attachment means. The swivel connector should be configured in such a manner as to attach to the vertical tube 420 and the attached horizontal portion of bail 450.

The radar reflector 405 serves as a mounting surface for flasher 470 which may be used to indicate the location of buoy 400 and associated equipment. Flasher 470 extends above radar reflector. In lieu of flasher 470, other signal devices may be used, such as radio beacons. Having the radar reflector 405 also act as a mount may provide a lighter and more efficient solution than the prior art, which includes attaching a radar reflector or other instruments to a mast. Weight saving may be an important factor in vertical buoy design, as any weight added near the top may need to be compensated by adding more ballast at the bottom. There may be very little excess buoyancy, so the additional weight of a radar reflector 405 and flasher 470 could exceed the capacity of a given design to stay vertical. The flasher 470 may be used in lieu of a mast, and may be attached directly to the radar reflector 405. The buoy 400 (including components such as a radar reflector 405), may be sunk to depths at or around four thousand (4000) meters, and then released. With the proper selection of materials and surface equipment, the buoy 400 could be designed to go to greater or lesser subsea depths as needed. Stainless steel band 498 is disposed at the distal end of the bail where it extends into a U-shape. Stainless steel band 498 is similar to a standard hose clamp with a screw.

Figure 5:
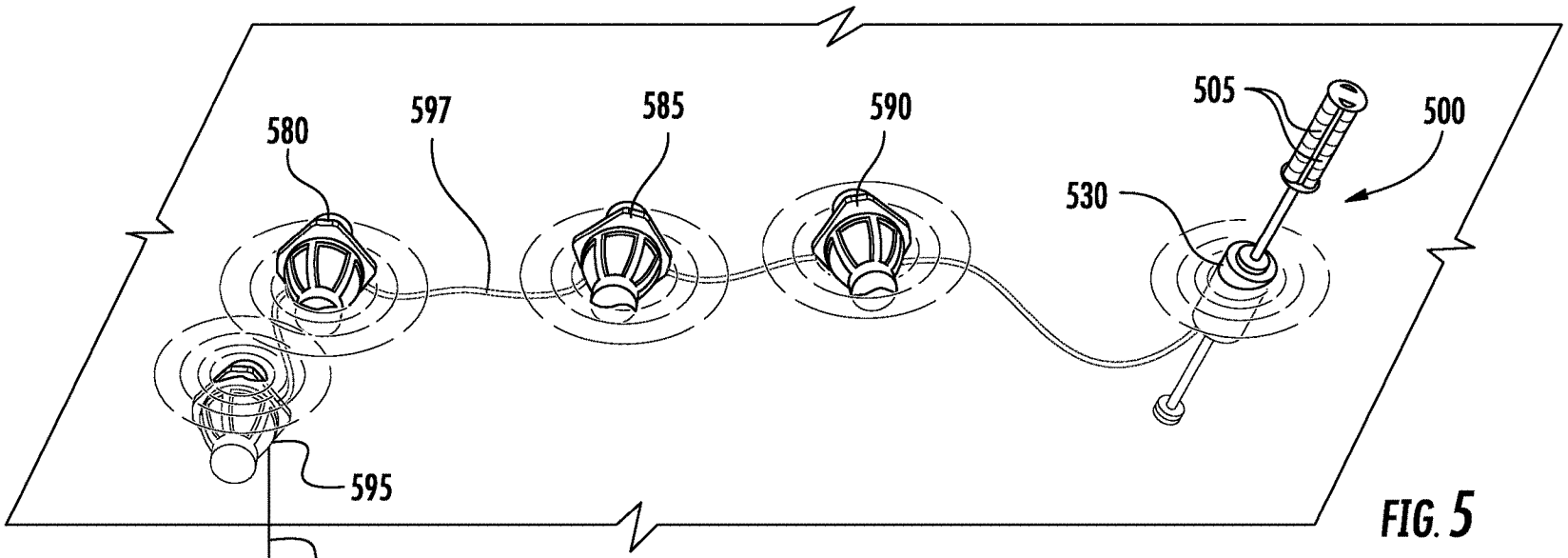
FIG. 5 is an illustration of the marker buoy along with spherical buoys that provide flotation for equipment, in accordance with one embodiment of the present disclosure.

FIG. 5 is an illustration of the marker buoy 500 of the present disclosure along with a radar reflector 505, flotation device 530 and four spherical buoys 580, 585, 590, 595. The pair of radar reflectors 505 are shown above the surface of the water. The flotation device 530 is also shown above the surface of the water. Vertical marker buoy 500 is connected, via a submerged cable 597, to four spherical buoys 580, 585, 590, 595, which are, in turn, connected to equipment 597 via attachment line 599. The four spherical buoys provide flotation for equipment that is attached to the marker buoy 500. Spherical buoys 580, 585, 590, 595 provide flotation for the equipment 597 until the equipment is recovered. As shown in FIG. 5, spherical buoy 595 is submerged due to the weight of the equipment 597 to which it is attached. Here, the vertical marker buoy 500 may be used in combination with spherical buoys 580, 585, 590, 595 to bring equipment 597 directly up to the surface from near the bottom. However the vertical marker buoy 500 could also be used as a "pop-up buoy," i.e., a buoy that brings attachment line 599 to the surface. The attachment line 599 could then be put on a ship's winch or capstan to bring up equipment 599 from the bottom. This approach may be needed when, for instance, the equipment 597 is too heavy to conveniently use floats.

Figure 6:
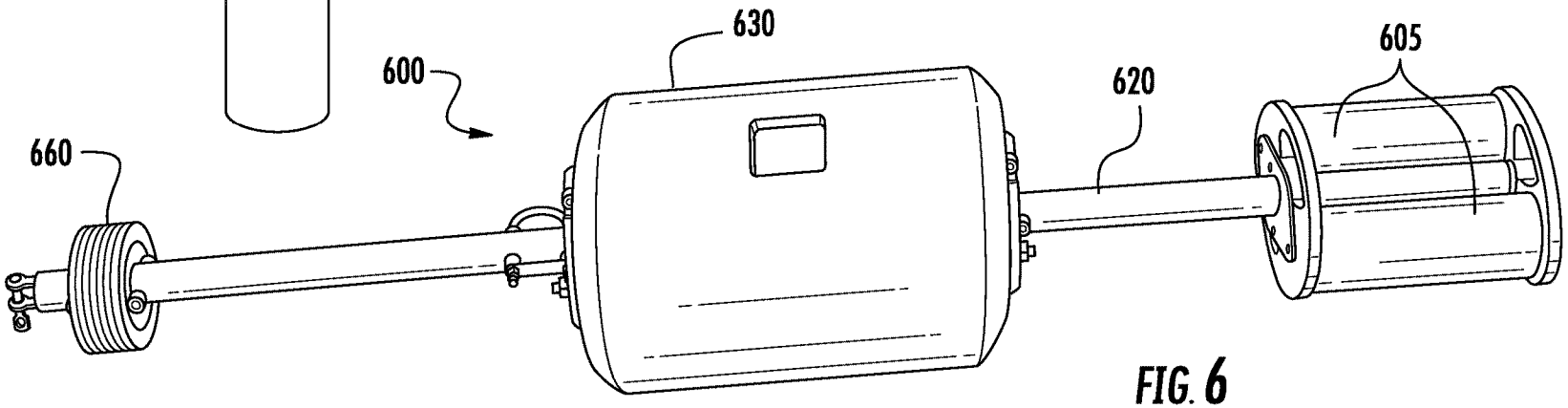
FIG. 6 shows another embodiment of the marker buoy without a bail, in accordance with one embodiment of the present disclosure.

FIG. 6 shows another embodiment of the marker buoy 600 without a bail. At the proximal end of the buoy 600 are radar reflectors 605, which are attached to tube 620. In this embodiment, a single cylindrical flotation device 630 is shown, instead of multiple flotation devices (such as those shown in FIGS. 1-4). Flotation may be attached to tube 620 via a mounting bracket or other attachment means. Ballast 660 is shown at the distal end of buoy 600. In this illustration, the ballast 660 is composed of small barbell weights. As this illustration shows, no bail is needed. However, if a bail is to be attached, the opposing sides of the cylindrical tube 620 could be flattened in order to accommodate a bail.

Figure 7:
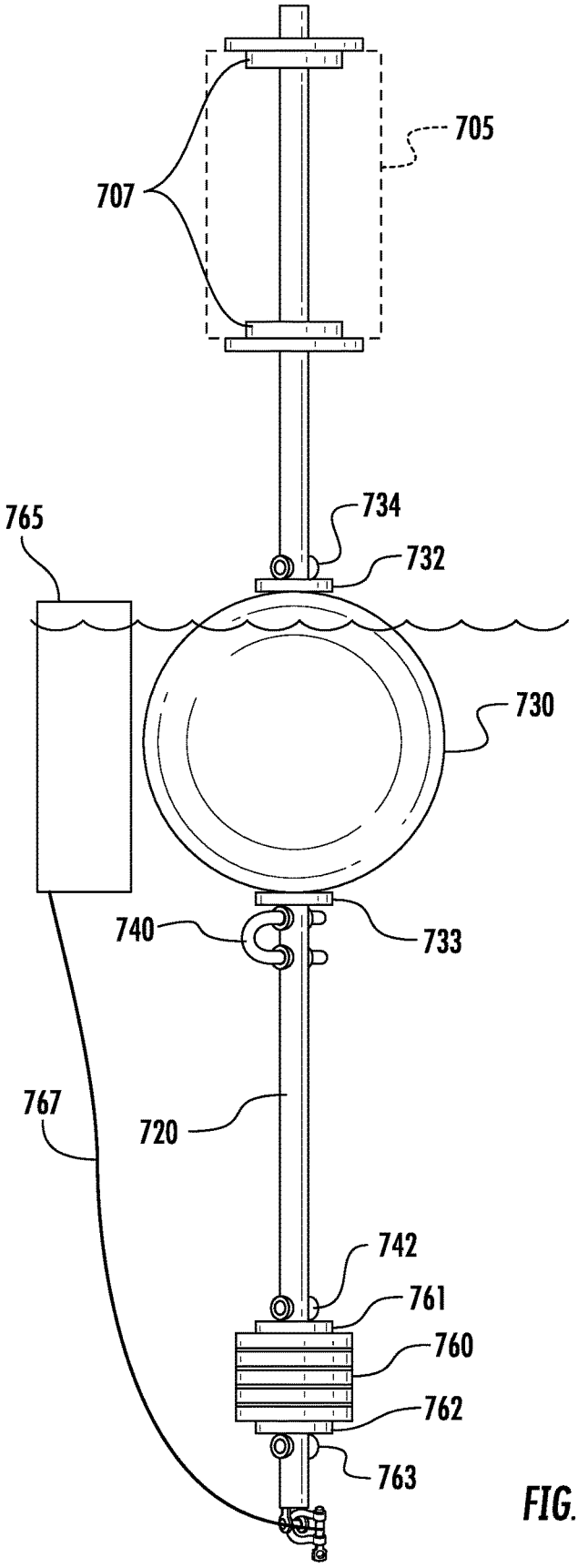
FIG. 7 shows a spherical version of the flotation device for the buoy, in accordance with one embodiment of the present disclosure.

FIG. 7 illustrates a spherical embodiment of the flotation device for the buoy in accordance with one embodiment of the present disclosure. No bail is attached in this embodiment. At the proximal end of the buoy 700 are radar reflectors 705. All of the elements of the embodiment of FIG. 7 are comprised of off-the-shelf items. In the present example, radar reflectors 705 are MOBRI® M-4 radar reflector, four inches (4") by twenty inches (20"). Radar reflectors 705 are attached to tube 720 using attachment devices 707. Attachment devices 707 may include two ultrahigh molecular weight (UHMW) polyethylene fixtures to secure radar reflectors 705. Attachment devices 707 may also include several socket head cap screws with nylon insert nuts that are used to secure each fixture to tube 720. As part of the attachment devices 707, band clamps may be used to secure reflectors to fixtures.

In the embodiment of FIG. 7, a single spherical flotation device 730 is used instead of multiple flotation devices. Spherical flotation device 730 may be secured to tube 720 using stainless steel washers 732, 733. In the present illustration, spherical flotation device 730 is an off-the-shelf FLOTEC® hardball float. It is about sixteen inches (16") in diameter. It is rated for five thousand meters (5000 m), twenty-four and a half pounds (24.5 lbs) buoyancy. It weighs about forty-eight and a half pounds (48.5 lbs) in air. The stainless steel washer 732 at the proximal end of tube 720 or buoy 700 may be further secured by a shoulder screw 734 with a nylon insert nut.

At the distal end of spherical flotation device 730, the distal end of tube 720 and the distal end of buoy 700, mooring line attachment 740 is placed next to stainless steel washer 733 in order to aid in securing washer 733 to tube 720. Mooring line 740 can be clipped to shoulder screw 742 at bottom of fiberglass tube 720 via fusible link for deployment. In this embodiment, mooring line attachment 740 is a metric U-bolt, with regular hex nut plus jam nut.

Ballast 760 is shown at the distal end of buoy 700. In this illustration, the ballast 760 is composed of five (5) small steel barbell weights, two and a half pounds (2.5 lbs) each with a polyvinyl chloride (PVC) sleeve as a spacer. As this illustration shows, no bail is needed. Ballast 760 is secured to tube 720 at the proximal end of tube 720 by shoulder screw 742 and stainless steel washer 761. At the distal end of the tube 720 and/or buoy 700, ballast 760 is secured by stainless steel washer 762 and shoulder screw 763. Shoulder screw 763 has a nylon insert nut. Equipment 765 is attached to the buoy 700 via an attachment line 767. In this illustration, equipment 765 is at the surface of the body of water.

The foregoing description of various preferred embodiments have been presented for purposes of illustration and description. It is not intended to be exhaustive or to limit the buoy and method to the precise forms disclosed, and obviously many modifications and variations are possible in light of the above teaching. The example embodiments, as described above, were chosen and described in order to best explain the principles of the buoy and method of deployment and their practical application to thereby enable others skilled in the art to best utilize the invention in various embodiments and with various modifications as are suited to the particular use contemplated. It is intended that the scope of the buoy and method be defined by the claims appended hereto.

We claim:

1. A vertical marker buoy, the vertical marker buoy comprising:

a first tubular member having an inner cylindrical wall, an outer cylindrical wall, a proximal end, a distal end and a length;

at least one flotation device having an inner cylindrical wall that is fixedly attached to the proximal end of the outer cylindrical wall of the first tubular member, wherein a width of the at least one flotation device is less than a length of the at least one flotation device;

at least one detection indicator that includes a visual indication of a location for the vertical marker buoy, wherein the at least one detection indicator is mounted at the proximal end of the vertical marker buoy;

a bail that is rotatably attached to the first tubular member, the bail being sufficiently long and wide to rotate around the length of the first tubular member; and wherein the vertical marker buoy is positively buoyant when the equipment is attached to the vertical marker buoy, and wherein the vertical marker buoy is in a substantially vertical position on a surface of a body of water when the vertical marker buoy is deployed; and wherein the vertical marker buoy is capable of being deployed from an underwater depth.

2. The vertical marker buoy of claim 1, further comprising:

a ballast having a ballast weight that facilitates positive buoyancy of the vertical marker buoy when the equipment is attached to the vertical marker buoy, wherein the ballast weight further facilitates positioning of the vertical marker buoy in the substantially vertical position on the surface of the body of water when the vertical marker buoy is in use.

3. The vertical marker buoy of claim 1, wherein the at least one detection indicator includes a radio beacon that is fixedly attached to a second tubular member having an outer cylindrical wall, wherein the second tubular member is fixedly attached to the proximal end of the first tubular member, and wherein the outer cylindrical wall of the second tubular member is sufficiently small to be fixedly attached to the inner cylindrical wall of the first tubular member.

4. The vertical marker buoy of claim 1, wherein the at least one detection indicator includes a flashing light that is mounted on, and fixedly attached to, a second tubular member having an inner cylindrical wall, and wherein the second tubular member is fixedly attached to the proximal end of the first tubular member, wherein the second tubular member has an outer cylindrical wall, and wherein the outer cylindrical wall of the second tubular member is sufficiently small to be fixedly attached to the inner cylindrical wall of the first tubular member.

5. The vertical marker buoy of claim 1, wherein the at least one detection indicator includes a radar reflector that is fixedly attached to the inner cylindrical wall of the flotation device.

6. The vertical marker buoy of claim 5, further comprising:

at least one other detection indicator that is fixedly mounted on the radar reflector.

7. The vertical marker buoy of claim 1, further comprising:

a mooring line attachment that attaches the vertical marker buoy to a mooring line, wherein the mooring line attachment is disposed at the distal end of the bail.

8. The vertical marker buoy of claim 1, wherein the flotation device is composed of syntactic foam.

9. The vertical marker buoy of claim 1, wherein the flotation device is cylindrical.

10. The vertical marker buoy of claim 1, wherein the flotation device is spherical.

11. The vertical marker buoy of claim 1, further comprising:

a mast; and wherein the at least one detection indicator is fixedly attached to the mast.

12. A method for deploying a vertical marker buoy, comprising the steps of:

attaching equipment to a vertical marker buoy, wherein the vertical marker buoy comprises:

a first tubular member having an inner cylindrical wall, an outer cylindrical wall, a proximal end, a distal end and a length;

at least one flotation device having an inner cylindrical wall that is fixedly attached to the proximal end of the outer cylindrical wall of the first tubular member, wherein a width of the at least one flotation device is less than a length of the at least one flotation device;

at least one detection indicator that includes a visual indication of a location for the vertical marker buoy, wherein the at least one detection indicator is mounted at the proximal end of the vertical marker buoy;

a bail that is rotatably attached to the first tubular member, the bail being sufficiently long and wide to rotate around the length of the first tubular member;

wherein the vertical marker buoy is positively buoyant when equipment is attached to the vertical marker buoy, and wherein the vertical marker buoy is in a substantially vertical position on a surface of a body of water when the vertical marker buoy is deployed; and wherein the vertical marker buoy is capable of being deployed from an underwater depth from an underwater depth, deploying the vertical marker buoy and attached equipment; in order to permit the vertical marker buoy and equipment to rise from a subsea depth to a surface of a body of water; and indicating, via the at least one detection indicator, the location of the vertical marker buoy and equipment.

13. The method of claim 12, wherein the deploying step further includes:

releasing the vertical marker buoy and equipment from an underwater mooring.

14. The method of claim 12, further comprising the step of:

facilitating, via a ballast, positive buoyancy of the vertical marker buoy when the equipment is attached to the vertical marker buoy.

15. A vertical marker buoy, the vertical marker buoy comprising:

a first tubular member having an inner cylindrical wall, an outer cylindrical wall, a proximal end, a distal end and a length;

at least one flotation device having an inner cylindrical wall that is fixedly attached to the proximal end of the outer cylindrical wall of the first tubular member, wherein a width of the at least one flotation device is less than a length of the at least one flotation device;

at least one detection indicator that includes a visual indication of a location for the vertical marker buoy, wherein the at least one detection indicator is mounted at the proximal end of the vertical marker buoy or first tubular member;

a bail that is rotatably attached to the first tubular member, the bail being sufficiently long and wide to rotate around the length of the first tubular member;

a ballast having a ballast weight that facilitates positive buoyancy of the vertical marker buoy when equipment is attached to the vertical marker buoy, wherein the ballast weight further facilitates positioning of the vertical marker buoy in a substantially vertical position on a surface of a body of water when the vertical marker buoy is deployed;

a mooring line attachment that attaches a mooring line to the distal end of the bail; and wherein the vertical marker buoy is positively buoyant when the equipment is attached to the vertical marker buoy, and wherein the vertical marker buoy is in a substantially vertical position on the surface of a body of water when the vertical marker buoy is deployed; and wherein the vertical marker buoy is capable of being deployed from an underwater depth.

16. The vertical marker buoy of claim 15, wherein the flotation device is composed of syntactic foam.

17. The vertical marker buoy of claim 15, wherein the at least one detection indicator includes a radio beacon that is fixedly attached to a second tubular member having an outer cylindrical wall, wherein the second tubular member is fixedly attached to the proximal end of the first tubular member, and wherein the outer cylindrical wall of the second tubular member is sufficiently small to be fixedly attached to the inner cylindrical wall of the first tubular member.

18. The vertical marker buoy of claim 15, wherein the at least one detection indicator includes a flashing light that is mounted on, and fixedly attached to, a second tubular member having an inner cylindrical wall, and wherein the second tubular member is fixedly attached to the proximal end of the first tubular member, wherein the second tubular member has an outer cylindrical wall, and wherein the outer cylindrical wall of the second tubular member is sufficiently small to be fixedly attached to the inner cylindrical wall of the first tubular member.

19. The vertical marker buoy of claim 15, wherein the at least one detection indicator includes a radar reflector capable of being fixedly attached to the inner cylindrical wall of the at least one flotation device.

20. The vertical marker buoy of claim 19, further comprising:

at least one other detection indicator that is mounted on the surface of the radar reflector.

* * * * *